United States Patent [19]

Baumann et al.

[11] 4,203,483

[45] May 20, 1980

[54] METHOD OF POSITIONING COMPONENTS OF A CENTRIFUGAL CASTING MACHINE FOR A MOLD STRIPPING OPERATION

[75] Inventors: Frederick W. Baumann, Scotia; Bernard C. Kaczkowski, Schenectady, both of N.Y.

[73] Assignee: General Electric Company, Schenectady, N.Y.

[21] Appl. No.: 2,416

[22] Filed: Jan. 10, 1979

Related U.S. Application Data

[62] Division of Ser. No. 795,757, May 11, 1977, Pat. No. 4,139,049.

[51] Int. Cl.[2] ..... B22D 13/10; B22D 29/04; B22D 33/04

[52] U.S. Cl. ..... 164/116; 164/131; 164/137

[58] Field of Search ..... 164/137, 131, 339, 344, 164/116; 29/426

[56] References Cited

U.S. PATENT DOCUMENTS

| | | | |
|---|---|---|---|
| 3,741,278 | 6/1973 | Baumann et al. | 164/137 X |
| 3,741,707 | 6/1973 | Baumann et al. | 164/292 X |
| 3,799,240 | 3/1974 | Baumann et al. | 164/298 |
| 3,821,980 | 7/1974 | La Bahn et al. | 164/131 X |
| 3,825,057 | 7/1974 | Baumann et al. | 164/292 |

*Primary Examiner*—Robert D. Baldwin
*Assistant Examiner*—J. Reed Batten, Jr.

[57] ABSTRACT

A positioning apparatus for a centrifugal casting machine having an articulated mold that is mounted for rotation in a cantilevered manner on a drive shaft. The positioning apparatus includes a pair of pillow block bearings having arcuate bearing races that operate to allow the drive shaft to be tilted within a predetermined angular range relative to its longitudinal axis. In addition, the positioning apparatus includes a plurality of locking pins each of which are mounted to cooperate respectively with one of a plurality of positioning members mounted on a rotatable mold-supporting face plate of the casting machine. Operation of the lock pins into engagement with the positioning members moves the face plate into a predetermined position relative to its axis of rotation, following a casting cycle of the machine, so that segments of the centrifugal mold can be radially stripped from an article cast therein without unduly distorting the cast article. Pursuant to the preferred method of the invention the drive shaft of a centrifugal casting machine is rotated about its longitudinal axis while the shaft is tilted within a predetermined angular range relative to a horizontal plane to perform a casting operation. Following the casting cycle, the drive shaft and rotatable casting mold of the machine are raised to a predetermined position of alignment above the tilted position of the shaft during the casting cycle, in order to position the mold for easy removal of mold segments from an article cast therein.

4 Claims, 3 Drawing Figures

METHOD OF POSITIONING COMPONENTS OF A CENTRIFUGAL CASTING MACHINE FOR A MOLD STRIPPING OPERATION

This is a division of application Ser. No. 795,757 filed May 11, 1977 and now U.S. Pat. No. 4,139,049 issued Feb. 13, 1979.

BACKGROUND OF THE INVENTION

This invention relates to positioning apparatus for a centrifugal casting machine and to a method for positioning components of such a machine during a casting operation and during a mold stripping operation. More particularly, the invention relates to bearing apparatus for supporting a drive shaft of a centrifugal casting machine for rotation within a predetermined angular range of tilt about its longitudinal axis, in combination with a plurality of lock pins and associated positioning members for moving a segmented centrifugal casting mold into a predetermined position following the formation of a cast article in the mold, thereby to facilitate retraction of the mold segments from an article cast therein. The invention also comprises a method for accurately positioning a centrifugal casting machine mold during casting rotation thereof and during a mold stripping operation in which segments of a mold are separated to enable a cast article to be removed from the mold.

The use of centrifugal molding apparatus is well known in the foundry art and has long been used to cast smooth surfaced articles such as railroad car wheels, seamless pipes and steel rods. However, the commercial utilization of segmented centrifugal molds to enable the casting of articles having irregular projections on their outer surfaces, such as the projecting cooling fins formed on cast aluminum housings for electric motors, is a relatively recent development, as shown, for example, in U.S. Pat. No. 3,825,057. That patent issued on July 23, 1974 and is assigned to the assignee of the present invention. Consistently reliable operation of such a mold to produce high quality castings can be improved, pursuant to the invention described herein, if the positioning of the mold is carefully controlled during certain casting and mold-stripping cycles.

It has also been discovered that by carefully controlling the positioning of such a mold in the portion of its operating cycle during which mold segments are stripped from an article cast therein, it is possible to realize a substantial savings in material costs. This desirable savings is due to the fact that such controlled positioning of the mold enables the wall thickness of the cast article to be significantly reduced without increasing the risk of the walls being distorted by a mold-stripping operation. Such a reduction in the wall thickness of consistently producible cast motor housings can be achieved, for example, if the position of a segmented mold for casting the housing is aligned accurately with its axis of rotation during an operation in which the casting mold is stripped from the housing. By so aligning the mold, projecting fins on the cast housing are prevented from binding in the mold segments as they are being retracted radially during the mold stripping cycle. On the other hand, if the mold is not accurately aligned with its axis of rotation during such a mold stripping operation, portions of the projecting fins on the housing may become bound in one or more of the mold segments as they are being retracted. Such a momentary binding between these parts frequently causes the cast to be distorted into an elliptical configuration, which often renders the casting unusable for its intended motor housing function. In order to partially counteract such undesirable distortions of motor housings produced by prior art centifugal casting methods, it was common practice to design relatively thick walled housings so the walls would have greater tensile strength for resisting distortion during a mold-stripping operation. Such thick walls were, in most cases, sufficiently strong to retain their desired cylindrical configurations even when one or more of the retractable mold segments became momentarily bound with the projecting fins of the housing during a mold-stripping operation. Thus, by using such thick walled housing configurations it was possible to avoid an unacceptably high rejection rate of the resultant castings but, of course, the manufacturing expense of the housings was undesirably increased by use of the extra casting metal used to form the thickness of their walls beyond the thickness required solely by their motor housing function.

A further difficulty encountered in the operation of centrifugal casting machines of the type that utilize a segmented mold mounted in cantilever fashion on a bearing-supported drive shaft, is that variable loading of the mold during an operating cycle exerts forces on the operating shaft causing it to either bend or tilt to different angular positions during sequential steps in the casting and mold-stripping cycles of the machine. These variable forces on the drive shaft cause undesirably rapid wear of the drive shaft supporting bearings if those bearings are required to maintain the shaft on a substantially fixed axis during all of the operating cycles of the machine. At the same time, as indicated above, it is desirable to provide positioning means for the shaft that are operable to accurately align it in a predetermined position during a mold-stripping operation in order to avoid binding of the mold segments while they are being retracted from an article cast therein. Thus, it would be desirable to provide a centrifugal casting machine having positioning means for allowing the drive shaft of the machine to be tilted within a predetermined angular range during the various operating cycles of the machine, in combination with positioning means for accurately aligning the mold with its axis of rotation during a mold-stripping operation.

OBJECTS OF THE INVENTION

Accordingly, it is a primary object of the present invention to provide a positioning apparatus and method for a centrifugal casting machine in order to economically overcome the problems noted above which are commonly encountered in the use of certain types of prior art centrifugal casting machines.

Another object of the invention is to provide positioning apparatus for a centrifugal casting machine that is operable to enable the machine to be tilted within a predetermined angular range relative to the axis of rotation of its drive shaft, while being further operable to move the mold of the machine to an accurately aligned position relative to its axis of rotation in order to perform a mold-stripping operation.

Yet another object of the invention is to provide a positioning apparatus for a centrifugal casting machine that is operable to move a segmented mold to a predetermined position for a stripping operation and to hold the mold in that position against the forces applied to the mold by a retracting operation during which mold segments are stripped from a cast article in four different directions.

A further object of the invention is to provide a method for positioning a centrifugal casting machine on a plurality of arcuate bearing means in a manner such that the drive shaft of the machine is allowed to tilt relative to its axis of rotation within a predetermined angular range, and to provide further positioning means for moving a segmented mold of the machine into a predetermined aligned position relative to its axis of rotation so that a mold segment stripping operation can be performed in an optimum manner that prevents the mold segments from binding on irregularities in the surface of an article cast therein.

Additional objects and advantages of the invention will be apparent from the description of it presented herein with reference to the appended drawings.

SUMMARY OF THE INVENTION

In a preferred form of the invention a positioning apparatus is provided for a centrifugal casting machine having an articulated mold mounted on a face plate that is rotatable on a bearing-supported drive shaft. The mold is positioned within a housing that supports pulling means for moving segments of the mold in a radial direction to strip the mold segments from an article cast therein, following a casting cycle of the machine. A plurality of pillow block bearings and thrust bearings are used to support the drive shaft of the machine for rotation within a predetermined angular range relative to its longitudinal axis. The bearings allow the drive shaft to be tilted downward at the mold-supporting end thereof during a centrifugal casting operation, and also enable the shaft to be accurately aligned in a predetermined position relative to the mold segment pulling or stripping means following such a casting operation. Further positioning means are provided to move the segmented mold into said predetermined position for performing a mold stripping operation thereon.

Pursuant to the method of the invention, the positioning apparatus is operated to support the drive shaft of the casting machine within said predetermined angular range of tilt relative to its longitudinal axis. Following a casting cycle during the operation of the machine, the second portion of the positioning apparatus of the invention is operated to raise the segmented mold to the above-mentioned predetermined position of arcuate alignment with the mold-stripping means so that the mold segments can be retracted from an article cast therein with a minimum degree of binding between the article and the mold segments. Indexing means are provided and operated following a casting cycle, pursuant to the method of the invention, to rotate the mold-supporting face plate of the casting machine into a predetermined position of accurate alignment with the mold raising and securing positioning apparatus of the invention.

DESCRIPTION OF THE PREFERRED EMBODIMENT

The preferred embodiment of the invention disclosed herein will be described with reference to its application on a centrifugal casting machine of a type somewhat related to the centrifugal casting machine shown in the above-mentioned U.S. Pat. No. 3,825,057. Accordingly, insofar as the general operating cycles of such a machine are concerned, reference may be made to that patent for a further description of the general operation of such a machine, as well as for a description of associated apparatus, such as suitable means for supplying molten aluminum or other metal to the casting machine via a reciprocally mounted ladle that is operable to transport molten metal into the segmented mold of the casting machine.

Figure 1:
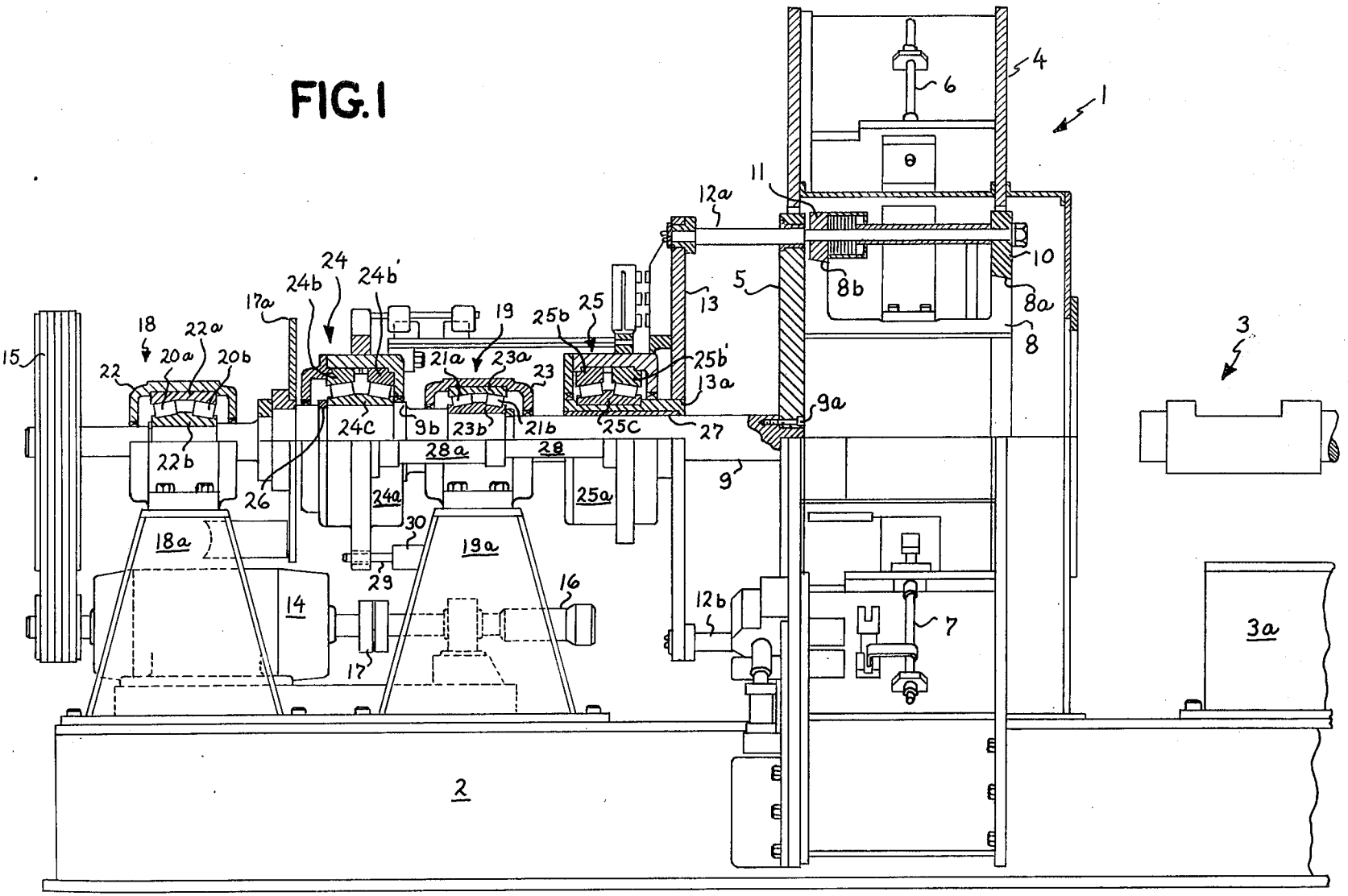
FIG. 1 is a side elevation, partly in cross-section, showing positioning apparatus constructed according to the invention and assembled in operating position on a centrifugal casting machine.

Referring to FIG. 1, it will be seen that there is shown a centrifugal casting machine 1 mounted in operating position on a suitable steel frame 2 in fixed relationship relative to a reciprocally mounted ladle 3 that is operable to deliver molten aluminum, or other suitable metal, to the segmented mold of the casting machine 1, in the manner generally described in the aforementioned patent. As explained in that patent, the ladle 3 is preferably mounted on a rotatable mandrel assembly **3*a* (not shown fully herein) that is operable to selectively position the ladle to first receive molten metal from a tundish connected to a conventional furnace for maintaining a supply of molten metal available for supplying the casting machine 1. The mandrel assembly also preferably has mounted thereon an expandable arbor (not shown herein) that is operable to be inserted within the casting machine 1** to extract therefrom a hollow cast article, such as a finned dynamoelectric machine housing, following formation of the cast housing in a centrifugal casting operation. Since an appropriate structure and mode of operation for such a mandrel assembly is sufficiently described in the above-mentioned patent, further description of it need not be presented herein in order to assure a complete understanding and orientation of the positioning means and method of the present invention.

As will be further appreciated from a reading of the foregoing patent, in conjunction with reference to the associated invention described therein in relation to the patents and patent applications referenced in U.S. Pat. No. 3,825,057, the centrifugal casting machine 1 typically includes a hollow housing such as the housing 4 shown in FIG. 1, that supports and houses an articulated mold that is mounted on a rotatable face plate 5. The housing 4 also supports in operating relationship four pulling means, two of which are partially shown as including the reciprocal pulling rods 6 and 7 in FIG. 1. These pulling means are selectively operable to move the mold segments, one of which is shown as segment 8 in FIG. 1, in a radial direction to alternately form a mold receptacle for receiving castable material, such as molten aluminum, or alternatively to separate the mold segments to permit removal of a cast article therefrom.

A suitable configuration and more detailed description of the operation of such mold segments is presented in the aforementioned patent, if such a detailed description is desired by the reader. For the purpose of adequately understanding the relationship of the positioning means of the present invention with respect to the centrifugal casting machine 1, it should also be appreciated that the face plate 5 is mounted in fixed relationship with respect to one end of the drive shaft 9 by any suitable mounting means, such as bolt(s) 9*a* shown in FIG. 1. In order to securely lock the mold segments tightly in position to form a mold receptacle for a casting operation, a pair of bevelled rings 10 and 11 are mounted in spaced relationship on a plurality of arcuately spaced rods, two of which are identified as rods 12*a* and 12*b* in FIG. 1. As explained in the above-mentioned patent, after the pulling means 6, 7, etc., are operated to move the four orthogonally interlockable segments of the articulated mold into juxtaposed relationship to form a mold receptacle, the rings 10 and 11 are drawn against suitably bevelled surfaces of the mold segments, for example, against the surfaces 8*a* and 8*b* shown in FIG. 1 on the mold segment 8, to tightly clamp the mold segments against one another and lock them in that relative position for a casting cycle of the machine. This clamping movement of the rings 10 and 11 is achieved by forcing a rotatable steel plate 13 to move away from the housing 4 and pull the ring supporting rods 12*a*, 12*b*, etc., with it. As described in detail in the above-mentioned patent, such operating movement is performed by relatively conventional hydraulic cylinders connected in operating relationship to the slidably mounted plate 13 and controlled in their operation by a suitable electrical control system such as that described in the patent.

Now that the general structure and mode of operation of the casting machine 1 has been described, only a few additional, relatively conventional components of the apparatus will be described before presenting a detailed description of the unique features of the present invention. Thus, it will be seen that there is shown in FIG. 1 a suitable conventional electrical drive motor 14 coupled by a plurality of drive belts 15 in driving relationship to a drive shaft 9 of the casting machine. A jogging motor 16 is selectively coupled to the drive motor 14 through a suitable electrical clutch 17 so that the face plate 5 can be rotated, or jogged, at reduced speed, following a casting operation, in order to move the face plate to a predetermined position for a purpose that will be more fully described below. A suitable electrical clutch for this purpose is described in U.S. Pat. No. 2,949,991, and U.S. Pat. No. Re. 25,516. As explained in U.S. Pat. No. 3,825,057, the drive motor 14 and jogging motor 16 are operated in a suitable sequence by an electrical control system from a stopped position in which molten metal is poured from the ladle 3 into the assembled mold segments, to an energized condition in which the motor 14 rotates the drive shaft at between three and four hundred revolutions per minute to centrifugally cast an article in the mold. After such a casting operation the motor 14 is deenergized and the rotation of drive shaft 9 is rapidly terminated by applying a braking force to brake disc 17*a* mounted on drive shaft 9 in a conventional manner. When the drive shaft has stopped, the jogging motor 16 is energized and clutch 17 is engaged to rotate the drive shaft 9 and face plate 5 to a predetermined position as will be more fully described below. Because the mode of operation of such a relatively conventional centrifugal casting operation is well-known in the art and is described more fully in U.S. Pat. No. 3,825,057, further description is not necessary here in order to enable those skilled in the art to fully understand the present invention.

Now that the general orientation of the major components of centrifugal casting machine 1 and its driving motors and associated metal supplying equipment have been explained, the positioning apparatus of the invention will be described. As indicated generally above, the positioning apparatus of the invention comprises first and second pillow block bearings 18 and 19 which are mounted respectively on conventional fabricated steel pedestals 18*a* and 19*a*, which in turn are bolted or otherwise secured in fixed, spaced relationship on the fabricated steel frame 2. The pillow block bearings 18 and 19 are substantially identical to one another and each comprise two sets of roller bearings 20*a*, 20*b*, and 21*a*, 21*b*, portions of which are shown in the cross-sectional view of the bearings illustrated in FIG. 1. Each of the sets of roller bearings 20*a*, 20*b* and 21*a*, 21*b* are positioned, respectively, on opposite sides of the central vertical axis of the respective bearings 18 and 19. Each of the bearings 18 and 19 further include an outer housing, such as the housings 22 and 23, in which there are mounted arcuate outer bearing races 22*a* and 23*a*, respectively. Inner bearing races 22*b* and 23*b* are mounted respectively in fixed relationship to the drive shaft 9 for rotation with it. The rotatable bearing members are conventional roller bearings 20*a*, 20*b* and 21*a*, 21*b*, and are positioned between the respective associated pairs of inner and outer bearing races in a suitable well-known manner. This particular bearing configuration is selected for the pillow block bearings of the positioning apparatus of the invention in order to allow the bearings to be operable to enable the axis of rotation of the drive shaft 9 to be tilted between the extremities of a predetermined angular range while the shaft is being rotated. In the preferred embodiment of the invention being described, that predetermined angular range is determined such that the end of the drive shaft 9 on which the face plate 5 is mounted may move vertically ¼ of an inch without causing the rotatable members 20*a*, 20*b* and 21*a*, 21*b* to extend beyond the axial limits of their associated outer races 22*a* and 23*a*.

Although a number of different conventionally available pillow block bearings may be used in various embodiments of the invention, it has been found that a type of bearing particularly suited for practicing the invention is a pillow block bearing sold by SKF Industries, Inc. of Pump Street and Erie Avenue, Philadelphia, Pa., under the catalogue numbers SKF22338 or SAF24052C.

The positioning apparatus of the invention further includes a first thrust bearing 24 mounted on the drive shaft 9 between the pillow block bearings 18 and 19, and a second thrust bearing 25 mounted on the drive shaft 9 between the second pillow block bearing 19 and the face plate 5. The thrust bearings 24 and 25 each comprise outer housings 24*a* and 25*a*, respectively, having outer bearing races 24*b*, 24*b*′ and 25*b*, 25*b*′, respectively, mounted therein, as shown in cross-section in FIG. 1. Associated inner bearing races 24*c* and 25*c* are mounted, respectively, around the drive shaft 9. The inner race 24*c* of the first thrust bearing is mounted in fixed relationship to the drive shaft 9 between a shoulder 9*b* on the shaft and a threaded sleeve 26, screwed onto the shaft, in a conventional manner. The inner race 25*c* of the second thrust bearing is mounted in reciprocal relation to a bearing sleeve 27 for relative movement with respect to drive shaft 9. The inner race 25*c* is mounted in fixed relationship to a second sleeve 13*a* that is welded to the rotatable plate 13 so that the inner race 25c is thereby held in fixed relationship to the plate 13 and in reciprocal sliding relationship relative to face plate 5.

Again, relatively conventional thrust bearings may be used for the thrust bearings 24 and 25 illustrated in the preferred embodiment of the invention described therein; however, it has been found that thrust bearings having catalogue number G3317C, supplied by Torrington Company of South Bend, Indiana are ideal for use in this application.

In order to prevent the outer housing 24a and 25a of the thrust bearings 24 and 25 from rotating with the drive shaft 9, while at the same time enabling these housings to be tilted relative to their respective vertical axes when the drive shaft is tilted, in the manner described above, in the arcuate pillow block bearings 18 and 19, the positioning apparatus of the invention is provided with means for preventing such rotation. In the preferred embodiment of the invention these means comprise a plurality of pistons, one of which is shown as piston 28, mounted respectively in a plurality of cooperating cylinders, one of which is shown in FIG. 1 as cylinder 28a mounted on the housing 24a of the first thrust bearing. In this embodiment of the invention only two such cooperating cylinders and pistons are utilized, one being the cylinder 28a and associated piston 28, shown mounted on the housing of bearing 25, and the other piston and cylinder arrangement being mounted on the opposite side of drive shaft 9. As can be seen in FIG. 1, since the piston 28 and cooperating cylinder 28a (and the associated other cylinder and piston, that is not shown) are mounted respectively in fixed relationship on the outer housings 24a and 25a of the thrust bearings, movement of the pistons in the cylinders, operates to selectively force the outer housings either together or away from one another thereby to drive the rotatable plate 13 to move rods 12a and 12b relative to the mold segments housed within housing 4, in a suitable manner such as that more fully described in U.S. Pat. No. 3,825,057. A suitable commercially available cylinder and piston for the piston 28 and cylinder 28a is sold under catalogue number 6-H-2HS-14-6, by the Cylinder Division of Parker Hannafin Company (address given below).

Finally, the means for preventing rotation of the thrust bearings 24 and 25 comprises a locking pin 29 mounted on the housing 24a of first thrust bearing 24 and positioned in sliding relationship with a latching member 30 that is bolted or otherwise suitably fixed in relationship to a suitable support means so that it is held in fixed position relative to drive shaft 9. In the embodiment of the invention shown in FIG. 1, the latching member 30 is a hollow steel cylinder sleeve structure bolted to the steel pedestal 19a. Of course, in alternative forms of the invention the latching member, which preferably is simply a sleeve structure, may be fixed to the housing of thrust bearing 24 and the pin 29 which reciprocates in the member 30 may be fixed to the support means 19a.

Figure 2:
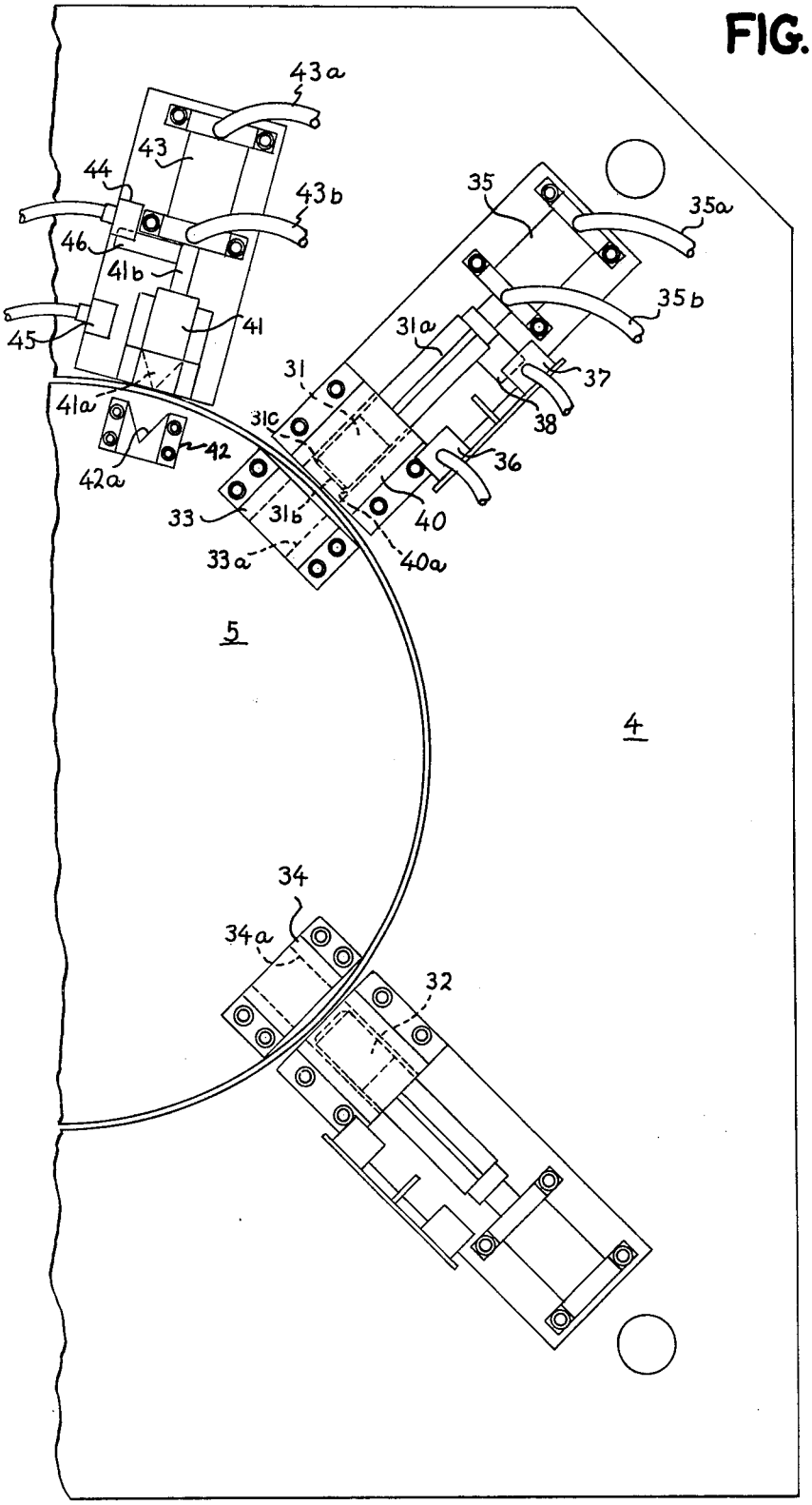
FIG. 2 is a fragmentary end view of a rotatable face plate and molding machine housing of the centrifugal casting machine shown in FIG. 1, illustrating a portion of the mold positioning apparatus of the invention including a face plate indexing means of the invention.

The positioning apparatus of the invention further comprises a plurality of lock pins reciprocally mounted on the housing 4 at spaced points around and radially outward from the face plate 5. In the embodiment of the invention being described, the plurality of lock pins includes at least four such pins that are substantially equally spaced around the face plate. Two of these lock pins 31 and 32 are shown in FIG. 2, spaced about 90° from one another. A plurality of cooperating positioning members are mounted at arcuately spaced points on the face plate 5 to each receive, respectively, one of the lock pins, in the manner that will be described more fully below. Two of these positioning members 33 and 34 are shown mounted on face plate 5 in FIG. 2 with respective cylindrical apertures 33a and 34a formed therein in substantial alignment with the pins 31 and 32.

The positioning members may take a variety of forms but in this embodiment of the invention they are steel blocks, roughly four inches square, through which cylindrical apertures, such as apertures 33a and 34a, respectively, have been bored. These apertures are about one and one-half inch in diameter in this form of the invention.

Reciprocal movement of the lock pins 31, 32, etc., is controlled by a plurality of hydraulic cylinders and associated electrical control circuitry connected thereto in a relatively conventional manner. Thus, as shown in FIG. 2, the lock pin 31 is mounted on a piston shaft 31a which supports a piston the position of which is determined by fluid in a hydraulic cylinder 35. In this form of the invention hydraulic fluid is supplied to the cylinder 35 through flexible tubing 35a and 35b which, it will be understood, are necessarily coupled to a suitable source of hydraulic fluid (not shown) under operating pressure. The pressure in the tubing should be in the range of 1,000 lbs. per square inch to provide sufficient pressure to drive the lock pin 31 into the positioning member 33 for practicing the invention in the preferred method more fully explained below.

Since all of the lock pins 31, 32, etc., of the invention are driven by substantially identical hydraulic and electric control means, only one such means, which is associated with the lock pin 31, need be described to explain their operation. Thus, in addition to the hydraulic supply means, tubing 35a and 35b, to control the position of lock pin 31, its position is controlled by conventional vane type limit switches 36 and 37 that cooperate with a reciprocating vane 38 mounted for movement with the piston rod 31a. Of course the switches 36 and 37 will be connected in operating relationship to a suitable source of electric energy such as a conventional 115 volt alternating current power distribution system (not shown). Although various conventional limit switches might be used for this purpose, in the preferred embodiment of the invention the limit switches 36 and 37 (and the other equivalent limit switches associated with the remaining lock pins) can be similar to those commercially available under catalogue number CR115A17, from the General Purpose Control Department of General Electric Company, located in Bloomington, Indiana. Similarly, although a variety of conventional piston and cylinder constructions may be used for the lock pin driving piston 35 (and other related pistons of the invention) a particularly preferred piston and cylinder construction for the preferred embodiment of the invention bears catalogue number 3Y4-C-C-2H-14-C7, and is sold by the Cylinder Division of Parker Hannafin Company, located at 50 South Wolf Road in Des Plains, Illinois.

The reciprocal path of movement of the lock pin 31 is precisely controlled by a guide member 40 having an aperture 40a that is cylindrical in configuration and is provided with an inner diameter that receives the pin 31 in a predetermined sliding tolerance. In this embodiment the guide member is simply a steel block having the aperture 40a bored through it. Finally, pursuant to the present invention, the lock pin 31 is provided with a radially inner end 31b that is bevelled from a minimum diameter at its innermost end to a maximum diameter between the ends of the lock pin. This bevelled surface is identified by the referenced numeral 31c in FIG. 2. In this embodiment of the invention the bevelled surface 31c extends radially outward from the inner end 31b of pin 31 an axial distance of approximately ¼ inch and the minimum diameter of the pin 31 is about ⅛ inch less than its maximum diameter. Consequently, the bevel on pin 31 and the identical bevels on the respective inner ends of the remaining lock pins 32, etc., are effective, when driven into the cooperating positioning means 33, 34, etc., to force them and, thus, the face plate 5, to a precisely positioned relationship relative to the axis of rotation of the face plate. In particular, this precisely positioned relationship is such that the axis of rotation of face plate 5, and the mold segments mounted thereon, is positioned substantially perpendicularly to the plane of movement of the mold segment retracting means 6, 7, et cetera. Accordingly, when the mold segments are withdrawn from an article cast in the mold, they are prevented from twisting or binding relative to the projecting fins or other irregular surfaces of the cast article. It will be appreciated that the precisely predetermined position in which the positioning members 33, 34, etc., are moved by their sliding relationship with the lock pins 31, 32, etc., is determined by the sliding tolerance between the lock pins and the cooperating cylindrical apertures 33a, 34a, etc., in the positioning members.

In order to provide a desired tolerance between the pins and their associated apertures through the positioning members, it is desirable to allow only three to five mils of sliding clearance between these components of the invention. Although the bevelled inner ends of the lock pins, for example, the bevelled surface 31c on pin 31, make it possible for the pins to be inserted into their associated positioning members without initially being in perfect alignment therewith, it is important to have the positioning members spaced in substantial alignment with the lock pins before their associated operating cylinders 35 are hydraulically energized, because the high pressure used to drive the pins forward could easily cause damage to the mechanism if such alignment is not first achieved. As mentioned, the hydraulic pressures used in the preferred embodiment of the invention are about 1,000 lbs. per square inch and the pin-driving cylinders 35, etc., are preferably one and one-half inches in diameter.

To achieve such precise indexing of the positioning members relative to the lock pins, the face plate 5 is jogged or slowly rotated after a casting operation, in the manner generally described above, to substantially align the positioning members 33, 34, etc., with their associated lock pins 31, 32, et cetera. However, to prevent damage due to slight misalignment of these components, in addition to the jogging means, the positioning apparatus of the invention comprises an indexing plunger 41 reciprocally mounted on the housing 4, and an indexing guide member 42 bolted or otherwise suitably secured to rotatable face plate 5. As shown in FIG. 2, the indexing plunger 41 is a steel pin having a substantially V-shaped tip 41a at its radially inner end, and the indexing guide member 42 is a formed steel block having a substantially V-shaped notch 42a in its radially outer surface for receiving the tip of the plunger slidably therein. Thus, the indexing guide member 42 cooperates with the indexing plunger 41, when it is driven radially inward, to rotate the face plate 5 sufficiently to move each of the positioning members 33, 34, etc., essentially into alignment, respectively, with one of the associated lock pins 31, 32, et cetera.

In this form of the invention the indexing plunger 41 is driven by a piston 41b connected to it and mounted within a driving cylinder 43, which is smaller but similar in construction and operation to the cylinder 35 and its associated piston rod 31a for lock pin 31, described above. Though various commercially available pistons and cylinders might be used for this purpose, the above-referenced Cylinder Division of Parker Hannafin Company supplies a cylinder under catalogue number 1-½-CC-2H-14-C4, that has been found desirable for use in driving the indexing plunger 41 in the preferred embodiment of the invention. Suitable flexible tubing 43a and 43b is connected to a source of hydraulic fluid (not shown), which is operable to supply such fluid under approximately 1,000 lbs. per square inch pressure to the cylinder. Likewise, a pair of vane type limit switches 44 and 45 operate in association with moving vane 46 mounted on piston rod 41b to control the movement of the hydraulic fluid to the respective ends of cylinder 43 in a conventional manner suitable to achieve the desired indexing operation of the plunger 41 heretofore described. Of course, various alternative means, such a manual actuation of such an indexing plunger could be used in alternative embodiments of the invention.

Figure 3:
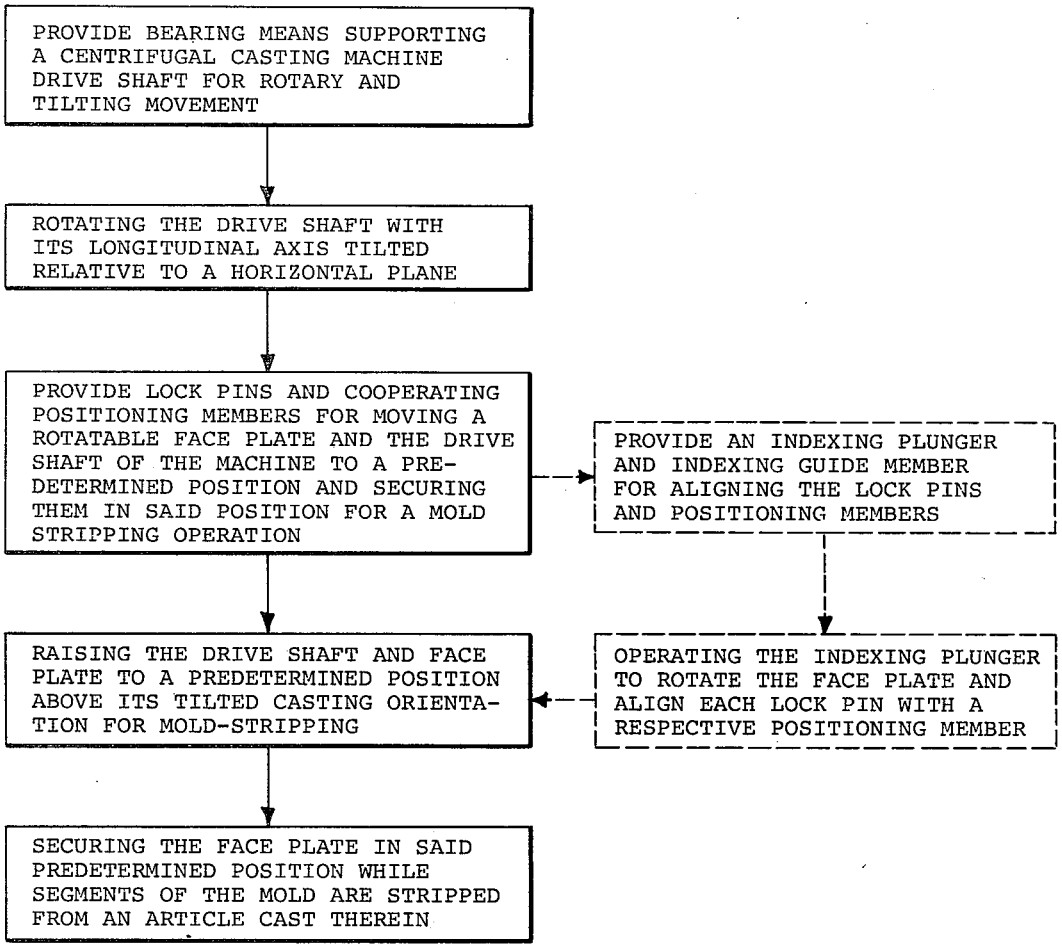
FIG. 3 is a chart showing the preferred steps of the method of the invention.

The operation of the positioning apparatus of the invention should be apparent to those skilled in the art from the description of it presented above. However, a fuller understanding of its operation will be explained now in connection with a description of the method of the invention. This method is generally outlined in the chart shown in FIG. 3. Referring to FIG. 3 it will be seen that there is set forth a methodology pursuant to the invention for accurately positioning a centrifugal casting machine having an articulated mold mounted on a face plate that is rotatable on a drive shaft within a housing that supports pulling means for moving segments of the mold in a radial direction to alternatively form a mold receptacle for receiving castable material or to separate the mold segments to enable removal of a cast article from it. The apparatus described above with reference to FIGS. 1 and 2 is suitable for use in practicing this method of the invention.

Pursuant to the method of the invention there is provided in combination with such a centrifugal casting machine a bearing means that is operable to support the casting machine drive shaft for rotation about its longitudinal axis while allowing the drive shaft to tilt relative to that axis within a predetermined angular range determined by the bearing means. There is also provided a plurality of lock pins, such as the lock pins 31, 32, etc. described above, mounted on the machine housing for moving the rotatable face plate of the machine to a predetermined position relative to its axis of rotation following a casting cycle in the machine operation. Positioning members such as the members 33, 34, etc. described above with reference to FIG. 2, are provided on the face plate 5 to cooperate with the lock pins to move the face plate to said predetermined position and secure it in that position while segments of the separable mold are pulled radially away from one another, thereby to remove them from an article cast therein. Finally, pursuant to the method of the invention means are provided for operating each of the lock pins to move them into positioning engagement respectively with each of the positioning members, after the rotatable face plate has been rotated and stopped to align the positioning members to receive the respective lock pins therein. Thus, the lock pins are effective to force the positioning members and the face plate to a predetermined position relative to the axis of rotation of the face plate. The desired precise positioning of the face plate facilitates removal of the mold segments from a molded article cast therein, for the reasons explained above.

In a still further method step of the invention an indexing plunger is provided in association with an indexing guide member mounted respectively on the housing 4 and the face plate 5 and operable to selectively move into indexing engagement with one another after the drive shaft of the centrifugal casting machine has stopped its driving rotation of the mold in a casting operation. This movement of the indexing plunger into engagement with the indexing guide member operates to force the face plate to rotate sufficiently to place the radially inner end of each of the lock pins in essentially accurate alignment with an aperture in a respective cooperating positioning member, so the locking pins can move into sliding engagement with the positioning members, without binding on the sidewalls thereof becoming blocked by the positioning members.

Thus, in practicing the preferred method of the invention with a suitable apparatus of the type just described, the following steps should be taken: With the casting machine assembled in operating condition and with suitable hydraulic and electric power sources connected, respectively, to the positioning means and their associated control mechanisms, the drive shaft first is rotated about its longitudinal axis with the axis of the drive shaft tilted relative to a horizontal plane. Following such a casting cycle, during which molten metal is centrifugally cast in the mold rotated on the drive shaft, the mold-supporting face plate is raised to a predetermined position, for a mold stripping operation. As noted above, the most desired predetermined position for the face plate during such a stripping operation is such that mold segments are pulled from the mold at a right angle to the longitudinal axis of the drive shaft. Finally, the face plate is secured in said predetermined position while segments of the mold are pulled radially from an article cast therein.

In practicing the method of the invention in the foregoing steps it is desirable to employ an additional step immediately after a casting cycle and before the mold is raised to its mold-stripping position. Pursuant to such a method, a plunger mounted on the housing is selectively moved into indexing engagement with a guide member on the face plate after the drive shaft has stopped rotating. Operation of the plunger rotates the face plate sufficiently to align it in cooperating relationship with lock pins mounted on the housing for raising the face plate into its mold-stripping position.

From the description of the invention it will be apparent that various modifications and alternative forms and arrangements of it may be practiced without departing from the invention; accordingly, it is our intention to encompass within the following claims the true spirit and scope of the invention.

What we claim as new and desire to secure as Letters Patent of the United States is:

1. A method for accurately positioning a centrifugal casting machine having an articulated mold mounted on a face plate that is rotatable on a drive shaft and within a housing that supports pulling means for moving segments of the mold in a radial direction to alternately form a mold receptacle for receiving castable material or to separate the mold segments to enable removal of a cast article therefrom, comprising the steps of:

(a) providing bearing means to support said drive shaft for rotation about its longitudinal axis while allowing the drive shaft to tilt along its axis within a predetermined angular range determined by said bearing means, (b) providing lock pins mounted on said housing for moving said face plate to a predetermined position relative to its axis of rotation following a casting cycle of its operation, (c) providing positioning members on said face plate to cooperate with said lock pins to move the face plate to said predetermined position and secure it there while segments of the mold are pulled radially away from one another to remove them from a cast article formed in the mold, and (d) providing means for operating each of the lock pins to move them into positioning engagement, respectively, with each of said positioning members after the face plate has been rotated and stopped to align the positioning members to receive therein said lock pins, whereby said lock pins are effective to force said positioning members and the face plate to a predetermined position relative to the axis of rotation of the face plate thereby to facilitate removal of the mold segments from an article cast therein.

2. A method as defined in claim 1 including the step of:

(b-1) providing an indexing plunger and an indexing guide member mounted respectively on said housing and said face plate and operable to selectively move into indexing engagement with one another after the drive shaft has stopped rotating the mold, thereby to force the face plate to rotate sufficiently to place the radially inner end of each of the lock pins in accurate alignment with a respective one of the positioning members so the lock pins can move into sliding engagement with said positioning members.

3. A method for accurately positioning a centrifugal casting machine having an articulated mold mounted on a face plate that is rotatable on a drive shaft and within a housing that supports pulling means for moving segments of the mold in a radial direction to alternately form a mold receptacle for receiving castable material or to separate the mold segments to enable removal of a cast article therefrom, comprising the steps of:

(a) rotating the drive shaft about its longitudinal axis with said axis tilted relative to a horizontal plane through the central axis of at least two bearings supporting said drive shaft for rotation, (b) raising the mold-supporting face plate and the drive shaft following a casting cycle to a predetermined position to pivot the drive shaft within said bearings and place the longitudinal axis of said drive shaft substantially in said horizontal plane for a mold-stripping operation, and (c) securing the face plate in said predetermined position while segments of the mold are pulled radially away from an article cast therein.

4. A method as defined in claim 3 including the step of:

(b-1) selectively moving a plunger mounted on said housing into indexing engagement with a guide member on the face plate after the drive shaft has stopped rotating, thereby to rotate the face plate sufficiently to align it in cooperating relationship with lock pins mounted on the housing for raising the face plate to said predetermined position.

* * * * *